United States Patent [19]

Franz et al.

[11] Patent Number: 5,003,871

[45] Date of Patent: Apr. 2, 1991

[54] INKING UNIT FOR A ROTARY OFFSET PRINTING MACHINE

[75] Inventors: Karl-Heinz Franz, Aschaffenburg; Heinrich Ochs, Sinntal; Kurt Difflipp, Dietzenbach/Steinberg, all of Fed. Rep. of Germany

[73] Assignee: Man Roland Druckmaschinen AG, Fed. Rep. of Germany

[21] Appl. No.: 535,995

[22] Filed: Jun. 8, 1990

Related U.S. Application Data

[63] Continuation of Ser. No. 160,590, Feb. 26, 1988, abandoned.

[30] Foreign Application Priority Data

Feb. 28, 1987 [DE] Fed. Rep. of Germany ..... 3706602

[51] Int. Cl.[5] ..... B41F 7/26; B41F 7/36; B41F 31/10

[52] U.S. Cl. ..... 101/148; 101/350

[58] Field of Search ..... 101/349, 350, 351, 352, 101/207-210, 148, 348, 147

[56] References Cited

U.S. PATENT DOCUMENTS

| | | | |
|---|---|---|---|
| 3,096,710 | 7/1963 | Wojciechowski | 101/148 |
| 4,485,737 | 12/1984 | Jeschke | 101/148 |
| 4,724,764 | 2/1988 | MacPhee | 101/148 |
| 4,729,308 | 3/1988 | Witczak | 101/148 |

FOREIGN PATENT DOCUMENTS

| | | |
|---|---|---|
| 1140204 | 6/1964 | Fed. Rep. of Germany . |
| 2106655 | 8/1972 | Fed. Rep. of Germany . |
| 2222581 | 11/1973 | Fed. Rep. of Germany . |
| 2302261 | 7/1974 | Fed. Rep. of Germany . |
| 3143909 | 5/1983 | Fed. Rep. of Germany . |
| 3334470 | 4/1985 | Fed. Rep. of Germany . |
| 3434647 | 4/1986 | Fed. Rep. of Germany . |

*Primary Examiner*—J. Reed Fisher

*Attorney, Agent, or Firm*—Leydig, Voit & Mayer

[57] ABSTRACT

An offset inking unit includes a distributor roll having a first roll train that communicates via a first branch roll with an ink transport roll engaged, as viewed in the direction of rotation of the plate cylinder, by two front inking rolls and having a second roll train connected in parallel to the first roll train that communicates via a second branch roll with a spreader roll which, as viewed in the direction of rotation of the plate cylinder, is engaged at least by the first inking roll of the two front inking rolls. Also as viewed in the direction of rotation of the plate cylinder, the second inking roll of the two front inking rolls communicates at least with another rear inking roll via another ink transport roll. Damping is optionally effected directly on the printing plate or on a front inking roll.

8 Claims, 6 Drawing Sheets

INKING UNIT FOR A ROTARY OFFSET PRINTING MACHINE

This is a continuation of copending application Ser. No. 07/160,590, filed on Feb. 26, 1988, now abandoned.

FIELD OF THE INVENTION

The present invention relates generally to an inking unit for a rotary offset printing machine and more particularly concerns an inking unit with a split inking path.

BACKGROUND OF THE INVENTION

In the prior art, DE-PS 3 334 470 shows a single-line inking unit for a rotary offset printing machine comprising a plurality of ink transport and inking rolls. The damping medium is fed to the first inking roll or the last inking roll or both. The ink is fed to a spreader roll associated with a first and second inking roll, five inking rolls being arranged successively at the plate cylinder in each case with a rider roll being disposed between each of them. The first rider roll and the third rider roll are constructed as distributor rolls. With the described arrangement of the five inking rolls and rider rolls, the pliability of the offset printing ink on the inking rolls decreases or is at least maintained from one inking roll to the next as viewed in the direction of rotation of the plate cylinder. The distribution behavior in the inking unit is thus optimized in that mottling can be extensively avoided.

If ink is supplied by only one flow of ink to the inking rolls, then if there are any variations in the proportion of damping medium at the distribution points situated in the flow of ink, the ink distribution ratios change. If the proportion of damping medium changes at the distribution points of the flow of ink due to a change in the supply of damping medium by a damping unit, particularly in the case of damping direct to the inking unit, then the ink supply (ink feed) must be readjusted to give the same application of ink to the printing plate. If the proportion of damping medium changes in the ink flow distribution points due to different quantities of damping medium on the printing plate, as a result of the distribution of printing and non-printing area components, then pulsation occurs in the flow of ink and produces mottling.

Inking units are generally known which divide up the flow of ink so that one component of the flow of ink is fed to the first inking roll or rolls and a second component is fed to the last inking rolls (see, for example, DE-PS 2 302 261, DE-PS 3 434 647, DE-PS 3 143 909). These inking units comprise a relatively large number of ink transport rolls in conjunction with one distributor roll, from which the two flows of ink are transferred to three or more inking rolls arranged successively at the plate cylinder. The distributor roll is coupled on the one hand to the ink feed system and on the other hand to branch rolls which feed the ink sub-flows to the inking rolls. In these inking units, readjustment of the ink feed in the event of variation of the ink distribution conditions in one component of the ink flow is not necessary but there is no guarantee of the ink transfer proportions of the individual inking rolls being graduated. In the extreme case, the ink transfer components of the last inking rolls become greater than those of the first inking roll or rolls, and this leads to the known mottling phenomena.

OBJECTS AND SUMMARY OF THE INVENTION

In view of the prior art, the primary aim of the present invention is to provide an inking unit which, while having little tendency to permit mottling, is also unaffected, with respect to the ink feed, to changes in the damping medium feed.

According to a broad object of the invention, the ink flow to the plate cylinder is subdivided into two flow paths.

More particularly, according to the invention An offset inking unit includes a distributor roll having a first roll train that communicates via a first branch roll with an ink transport roll engaged, as viewed in the direction of rotation of the plate cylinder, by two front inking rolls and having a second roll train connected in parallel to the first roll train that communicates via a second branch roll with a spreader roll which, as viewed in the direction of rotation of the plate cylinder, is engaged at least by the first inking roll of the two front inking rolls. Also as viewed in the direction of rotation of the plate cylinder, the second inking roll of the two front inking rolls communicates at least with another rear inking roll via another ink transport roll. Damping is optionally effected directly on the printing plate or on a front inking roll.

The particular advantages of the invention are as follows: the inking rolls transfer to the printing plate graduated ink transfer components, decreasing from the first inking roll of the two front inking rolls to the last inking roll as viewed in the direction of rotation of the plate cylinder. The ink feed, and hence the ink gradient in the inking unit, also remain substantially constant if changes in the damping medium supply due to changes of the setting of the damping unit or due to different quantities of damping medium on the printing plate cause changes in the ink distribution conditions, particularly at the distribution points between the front spreader roll and the adjoining inking rolls and in the branch roll situated in this line of ink.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
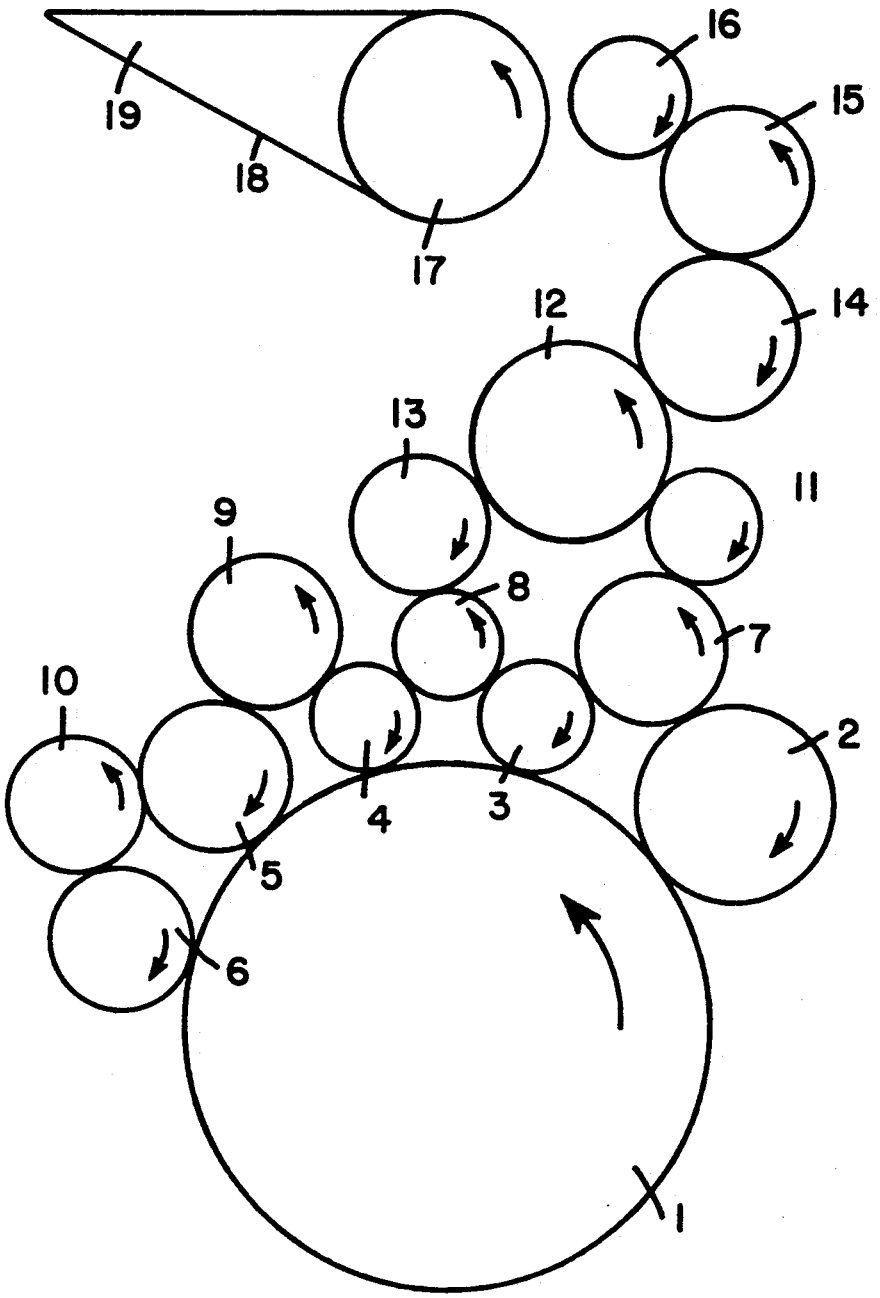
FIG. 1 is a diagrammatic side elevation of the inking unit according to the invention.

Turning now to the drawings, there is shown in FIG. 1 a driven ductor roll 17 immersed in known manner in the printing ink 19 of a duct 18 of a rotary offset printing machine. A vibrator roll 16, which rocks to and fro pendulum-fashion, takes fresh printing ink 19 from the ductor roll 17 and transfers it to a plastic-coated ink spreader 15. The parts 15–18 form a conventional ink supply system for a printing machine.

From the ink spreader 15, the ink flow runs via a rubber-coated ink supply roll 14 to a plastic-coated coated primary distributor primary roll 12. The roll 12 divides the flow of ink into two sub-flows, one of which is fed to a first rubber-coated branch roll 13 and the other to a second rubber-coated branch roll 11. The first sub-flow is fed to two front inking rolls 3, 4 via the first branch roll 13 and an ink transport roll 8, which can optionally be in the form of a spreader roll. The second flow of ink is fed via the second branch roll 11 and a spreader roll 7 to the first primary inking roll 3 of the two front inking rolls 3, 4 (see FIG. 4) or additionally to another inking roll 2, which, as viewed in the direction of rotation of the plate cylinder 1, precedes the first inking roll 3 of the two front inking rolls 3, 4 (see FIGS. 1 to 3). The inking rolls 2–4 ink an offset printing plate which is clamped on the plate cylinder 1.

The second or secondary inking roll 4 of the front two inking rolls 3 and 4, as viewed in the direction of rotation of the plate cylinder 1, is followed by a further inking roll 5 and optionally by a rear inking roll 6. The inking rolls 5 and 6 also have rolling contact with the printing plate and are rubber-coated like the front inking rolls 2–4. A plastic-coated spreader roll 9 rolls on the inking rolls 4 and 5, and a plastic-coated ink transport roll 10 is placed on the inking rolls 5 and 6 and acts as a rider roll.

Figure 2:
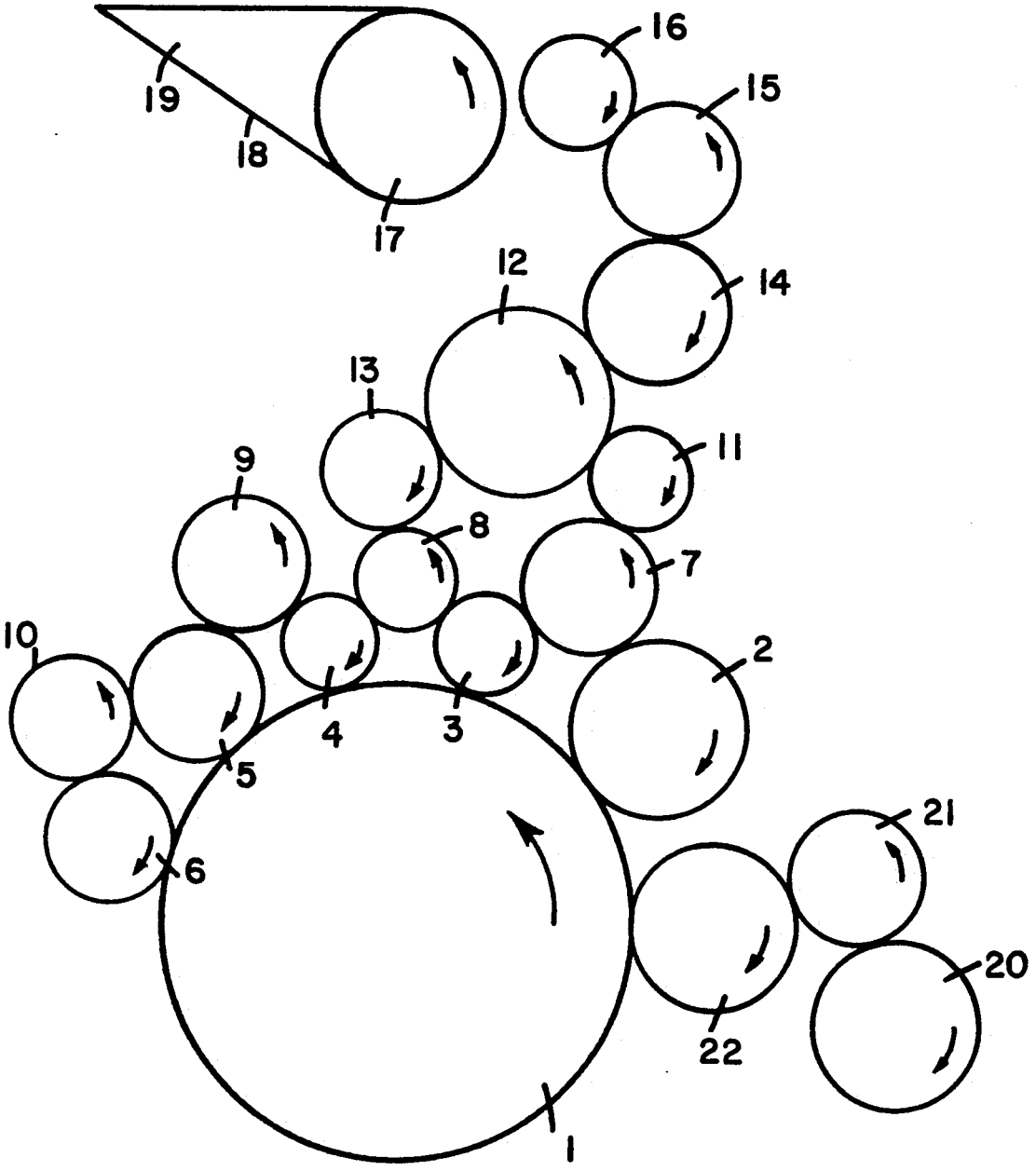
FIG. 2 shows the inking unit of FIG. 1 with the printing plate damped directly by means of a damping roll.
Figure 3:
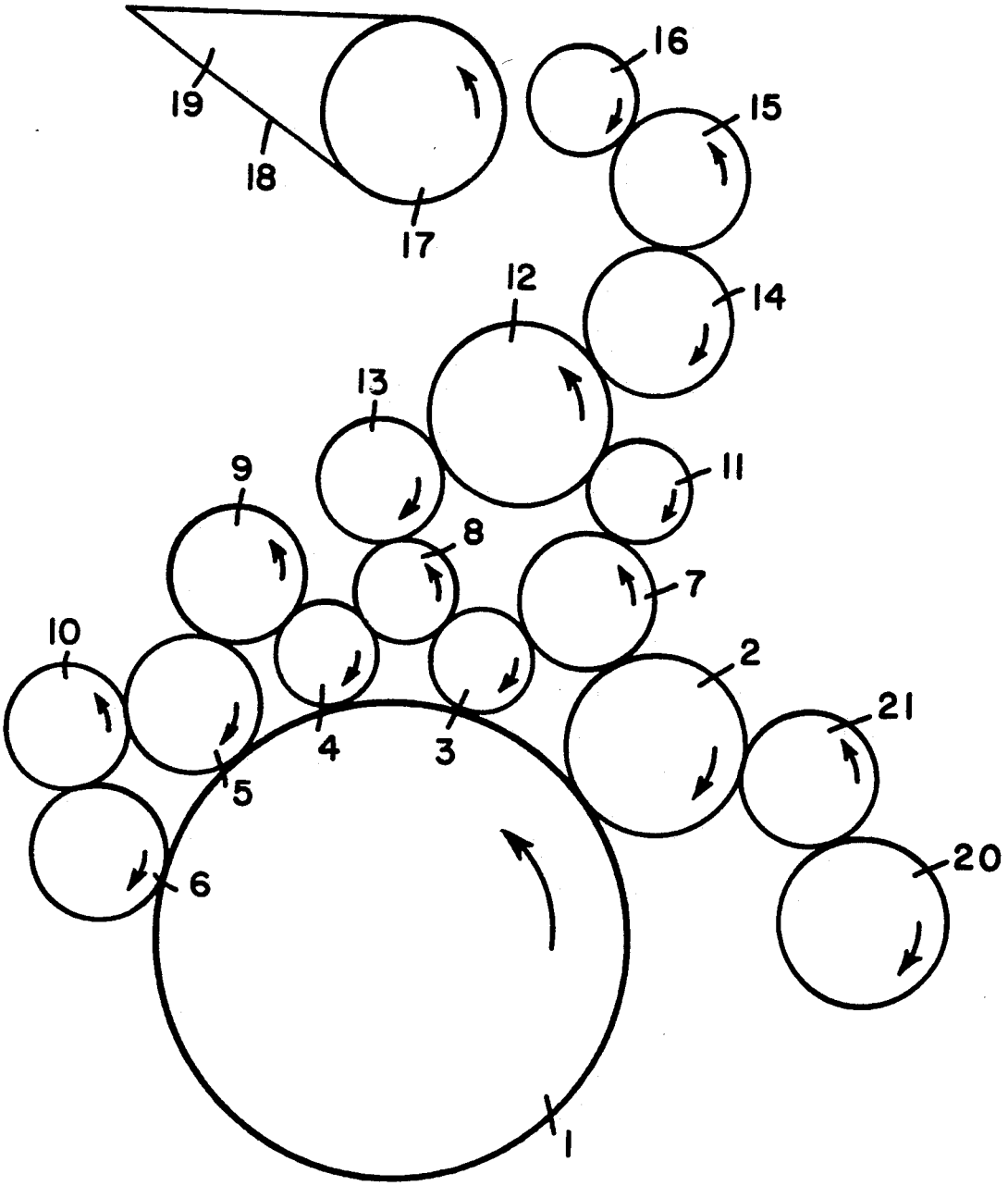
FIG. 3 shows the inking unit of FIG. 1 with the printing plate damped directly via the first inking roll.

Damping of the printing plate is effected optionally in two alternate methods:

1) directly via a damping roll 22 (FIGS. 2 and 4); or, 2) via the inking roll 2 (FIG. 3).

The damping roll 22 and the inking roll 2 are fed with damping medium from a damping medium ductor roll 20 via an intermediate roll 21 in a conventional manner for printing machines.

If the ink distribution conditions in the second sub-flow change, due to the damping medium supply, so that the ink distribution is obstructed and hence the proportion of ink in the second sub-flow decreases, the proportion of ink in the first sub-flow automatically increases by that amount. The ink transfer component of the inking roll 2 decreases (in accordance with the arrangement shown in FIGS. 1 to 3) and the ink transfer component to the inking roll 3 (in accordance with the arrangement shown in FIG. 4). The ink transfer components of the inking rolls 3 to 6 at the same time increase by this amount, the graduation of the ink transfer components of the inking rolls 3 to 6 as viewed in the direction of rotation of the plate cylinder 1 being maintained. The total ink gradient in the inking unit remains constant and hence the same applies to the setting of the ink supply to the inking unit, i.e., the ink feed.

The effect according to the invention can also be further improved in a manner already known in the art, if the first branch roll 13 is constructed as a traversing spreading roll and/or the first branch roll 13 is mounted so as to be engageable with and disengageable from the adjoining rolls 8, 12 or so as to be engageable and disengageable with cyclic control.

Figure 4:
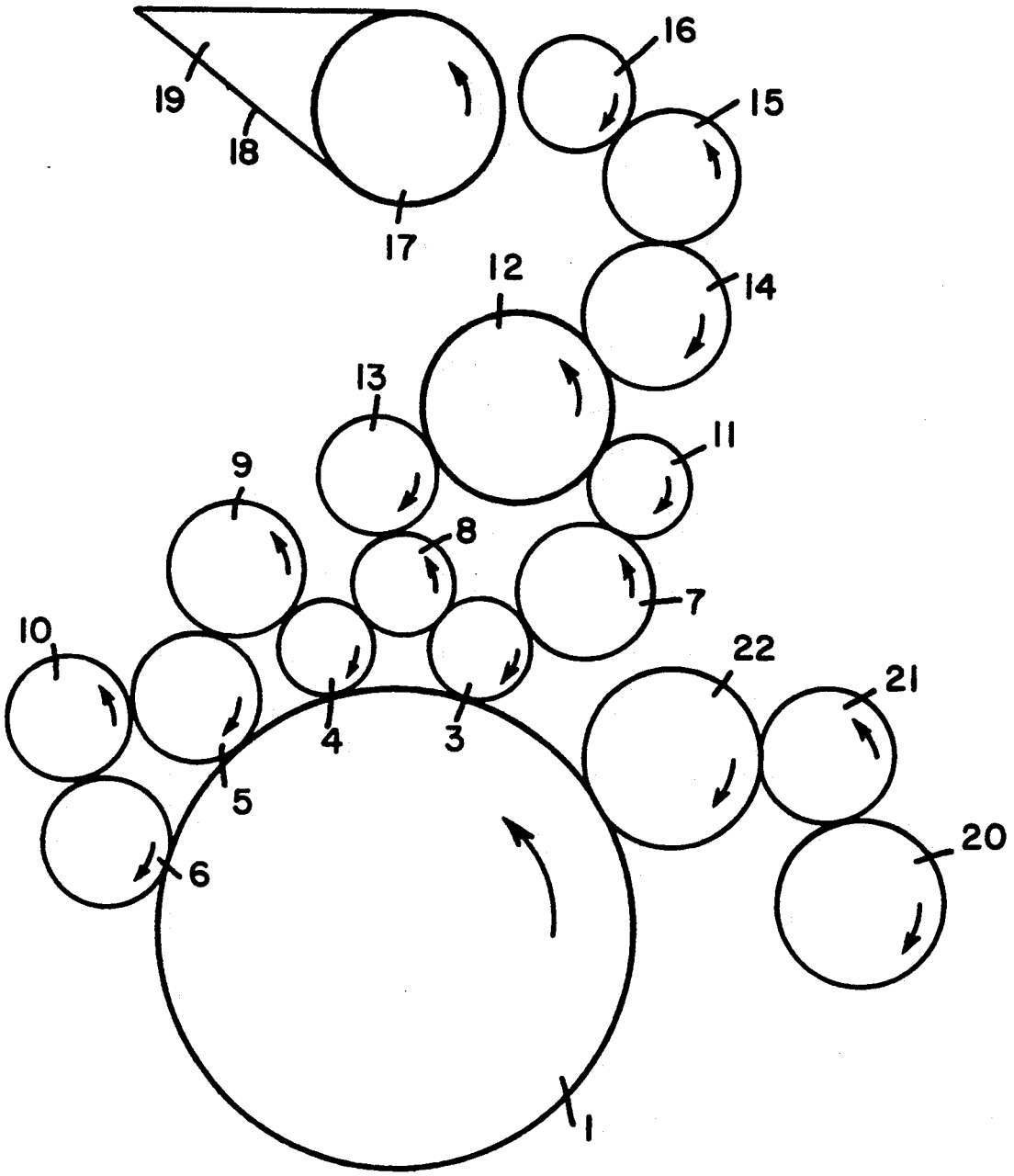
FIG. 4 shows another embodiment of the invention with the printing plate damped directly via a damping roll.

In order to optimize the inking of the plate cylinder 1 the first four inking rolls 2–5 are designed, as viewed in the direction of rotation of the plate cylinder 1, for the transfer of the following maximum proportions of ink; the rolls being respectively referred to as another, primary, secondary and further:

| | |
|---|---|
| Referring to FIG. 2 | |
| another inking roll 2 | 32% |
| primary inking roll 3 | 38% |
| secondary inking roll 4 | 26% |
| further inking roll 5 | 4% |
| Referring to FIG. 3 | |
| another inking roll 2 | 9% |
| primary inking roll 3 | 49% |
| secondary inking roll 4 | 35% |
| further inking roll 5 | 7% |
| Referring to FIG. 4 | |
| primary inking roll 3 | 62% |
| secondary inking roll 4 | 32% |
| further inking roll 5 | 6%. |

Figure 5:
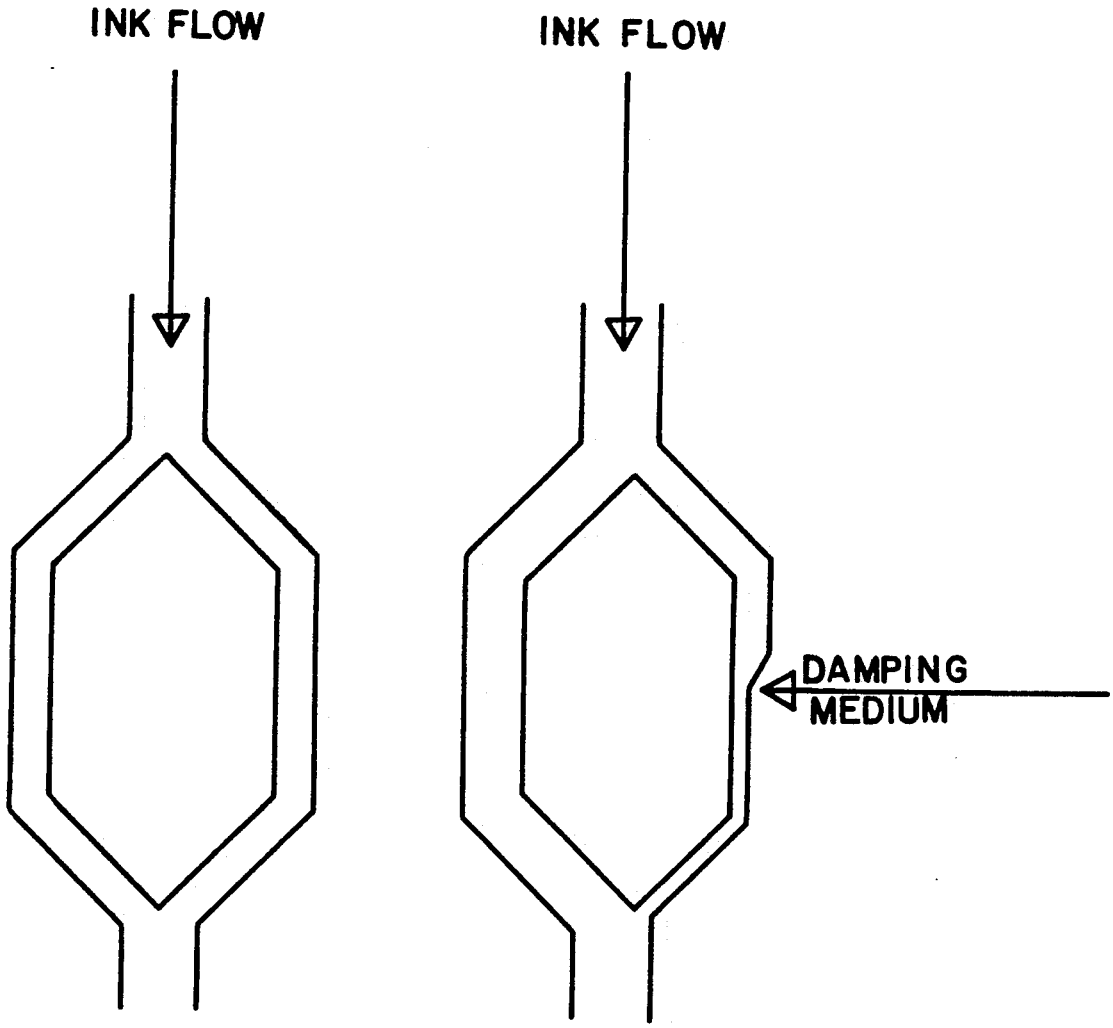
FIG. 5 diagrammatically illustrates the flow of ink to the printing plate; and, FIG. 6 illustrates another embodiment of the invention.

The diagrams of FIG. 5 each show an ink flow to the plate cylinder 1, the left-hand diagram illustrating the case in which the ink transfer takes place without obstruction, while the right-hand case is one in which the damping medium supplied obstructs the flowthrough in one sub-flow, resulting in a shift of the flowthrough quantity to the other sub-flow.

Figure 6:
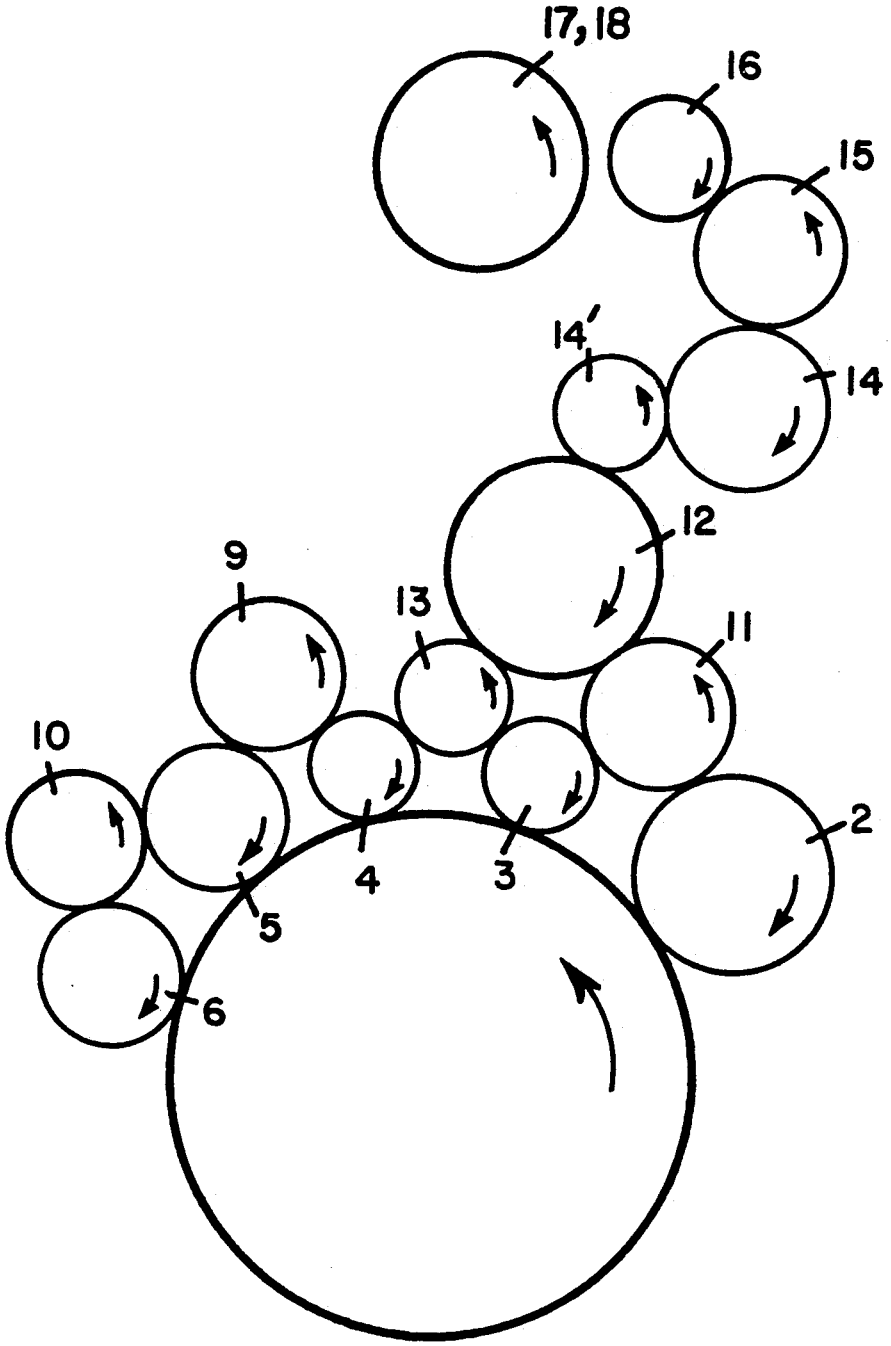

FIG. 6 shows another embodiment of the invention in which a parallel ink flow precedes the front inking roll. The distributor roll 12 and the front inking roll 3 are in direct communication via the branch roll 13 provided in the first roll train, and via the branch roll 11 provided in the second roll train, without other ink transport rolls being interposed.

We claim as our invention:

1. An inking unit for a rotary offset printing machine having a plate cylinder, a damping system and an ink supply system including a plurality of ink transport rolls for delivering ink to a plurality of inking rolls engaging the plate cylinder comprising, in combination, one of said ink transport rolls being a primary ink distributor roll, said inking rolls including a front roll pair including a primary ink applicator roll and a secondary ink applicator roll, means including a first branch roll for conveying ink from said primary ink distributor roll to said primary and secondary ink applicator rolls, means including a second branch roll for also conveying ink from said primary ink distributor roll to said primary ink applicator roll, said first and second branch rolls being disposed respectively in first and second roll trains to define first and second parallel subflow paths of ink conveyed from said primary ink distributor roll to said primary ink applicator roll, said first and second roll trains each having adjacent rolls, said secondary ink applicator roll being coupled to said first roll train and disposed to engage the plate cylinder after the engagement of said primary ink applicator roll with the plate cylinder, said inking rolls including at least one further ink applicator roll engaging the plate cylinder after the engagement of said secondary ink applicator roll with the plate cylinder, a rider roller engaging said secondary ink applicator roll and said further ink applicator roll, said further ink applicator roll being coupled to said first ink subflow path only by said rider roller, means for enabling at least one of said branch rolls for selective engagement with and disengagement from at least one of the adjacent rolls in the respective one of said first and second roll trains, and said damping system including means for conveying damping fluid to the plate cylinder in advance of the engagement of said primary ink applicator roll with the plate cylinder, such that increases in the amount of damping fluid conveyed to the plate cylinder automatically decrease the flow of ink in said second subflow path relative to the flow of ink in said first subflow path.

2. An inking unit according to claim 1 wherein said first and second roll trains each includes a rider roll engaging said primary ink applicator roll.

3. An inking unit according to claim 2 wherein at least one of said rider rolls is a transversely oscillating spreader roll.

4. An inking unit according to claim 1 wherein at least one of said branch rolls is a transversely oscillating spreader roll.

5. An inking unit according to claim 1 wherein said inking rolls include another ink applicator roll coupled to said second roll train and disposed to engage the plate cylinder ahead of the engagement of said primary ink applicator roll with the plate cylinder.

6. An inking unit according to claim 5 wherein said damping system is disposed to apply damping fluid on said another ink applicator roll.

7. An inking unit according to claim 5 wherein said damping system is disposed to apply damping fluid directly on the plate cylinder ahead of the engagement of said another ink applicator roll with the plate cylinder.

8. An inking unit according to claim 7 wherein said another ink applicator roll conveys damping fluid from the plate cylinder to said second branch roll.

* * * * *